United States Patent [19]

Davidson et al.

[11] 4,185,766

[45] Jan. 29, 1980

[54] TWO BULB CARTON

[75] Inventors: Thomas L. Davidson, Uncasville; Robert A. Hackenberg, East Lyme, both of Conn.

[73] Assignee: Robertson Paper Box Co., Inc., Montville, Conn.

[21] Appl. No.: 3,543

[22] Filed: Jan. 12, 1979

[51] Int. Cl.[2] ..... B65D 5/02; B65D 85/42

[52] U.S. Cl. ..... 229/39 B

[58] Field of Search ..... 229/39 B; 206/422

[56] References Cited

U.S. PATENT DOCUMENTS

| | | | |
|---|---|---|---|
| 1,347,899 | 7/1920 | Edington | 229/39 B X |
| 2,690,254 | 9/1954 | White | 229/90 X |
| 2,825,496 | 4/1958 | Miessler, Sr. | 229/39 B X |
| 2,892,581 | 6/1959 | Amatel | 229/90 |
| 3,116,004 | 12/1963 | Tyrseck et al. | 229/39 B |
| 3,145,836 | 8/1964 | Tyrseck et al. | 229/39 B |
| 3,820,707 | 6/1974 | Fischer et al. | 229/39 B |
| 3,968,924 | 7/1976 | Tyrseck | 229/39 B |
| 4,007,836 | 2/1977 | Getz et al. | 229/39 B X |

*Primary Examiner*—Davis T. Moorhead

*Attorney, Agent, or Firm*—Cesari and McKenna

[57] ABSTRACT

A two bulb carton formed from a single blank with a step fold has partition walls which space the bulbs from the carton outer walls and from each other.

7 Claims, 6 Drawing Figures

TWO BULB CARTON

This invention relates to a carton for protectively enclosing a pair of lightbulbs, globes, or other fragile articles. It relates more particularly to a carton of this type made from a single blank of material which may be stored in a flattened condition when not in use.

BACKGROUND OF THE INVENTION

Lightbulbs are normally shipped and stored in generally rectangular protective enclosures. These may simply be open-ended corrugated cardboard sleeves or more elaborate cartons having interior partitions which are intended to isolate the bulbs from each other and from the outside walls of the carton so that the bulbs are protected and buffered from shocks encountered during normal handling of the carton. Examples of such prior cartons are disclosed in U.S. Pat. Nos. 2,892,581; 2,825,496; 1,347,899; 1,626,971; 3,116,004; 3,145,836 and 2,690,254.

Some prior cartons and boxes of this general type are disadvantaged because they do not adequately protect all areas of the bulbs. In some cases, various apertures must be formed in the carton sidewalls in order to create interior panels to protect the contents. These apertures provide access into the carton for dirt and grit which can mar the surfaces of the contents. Also elongated objects such as sticks, rods and wire can project into these apertures and actually destroy the contents.

Other cartons of this general type use an excessive amount of board material or require several folding and glueing operations to form the finished carton. Therefore, they are relatively expensive to make in terms of material and set-up costs.

SUMMARY OF THE INVENTION

Accordingly, the present invention aims to provide a carton for a pair of lightbulbs or other fragile articles which gives a maximum amount of protection to the carton contents.

A further object of the invention is to provide a carton for a pair of bulbs or other fragile articles which requires a minimum amount of board stock.

Yet another object of the invention is to provide a carton of this general type which is made from a single cardboard blank with a minimum number of folding and glueing steps.

A further object of the invention is to provide a dual lightbulb carton which isolates all sides of the bulbs from each other and from the walls of the carton.

Still another object is to provide a cardboard blank for making a bulb carton having one or more of the above characteristics.

Other objects will, in part, be obvious and will, in part, appear hereinafter.

The invention accordingly comprises the features of construction, combination of elements and arrangement of parts which will be exemplified in the construction hereinafter set forth, and the scope of the invention will be indicated in the claims.

Briefly, the subject carton has four generally rectangular outer walls hinged together to form an open-ended tube. A generally U-shaped panel structure is located inside the tube at one end. The legs of the U-shaped structure comprise two parallel partitions spaced unequal distances from one pair of opposite carton sidewalls. The ends of the legs of the panel structure as well as its bridge portion are secured to the other pair of opposite carton sidewalls so that relatively wide and relatively narrow compartments are formed side by side at one end portion of the carton.

A second generally U-shaped panel structure is positioned inside the opposite end of the tube. The second structure also has legs which form two parallel partitions spaced unequal distances from said one pair of opposite carton sidewalls but in the opposite sense. Thus the two U-shaped panel structures are staggered so that the inboard legs of the two structures overlap adjacent the longitudinal centerline of the carton. The ends of the legs of the second panel structure as well as its bridge portion are also secured to the other pair of opposite carton outer walls so as to form relatively wide and relatively narrow compartments at the other end of the carton.

Generally elliptical tongues or flaps are formed in the partitions which form apertures in those partitions for receiving and retaining a pair of lightbulbs inserted lengthwise into the carton from opposite ends thereof. These flaps further function to isolate the bulbs from the carton outer walls so that the bulbs are buffered from impacts against the carton. The relatively large area overlapping margins of the two inboard legs of the panel structures also provide a double wall separating the two bulbs at their weakest points so that the bulbs are also cushioned from each other.

The U-shaped panel structures are formed by a step fold in the carton blank using a minimum amount of board stock. Consequently, the carton is less expensive to make than prior comparable bulb containers of this general type.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
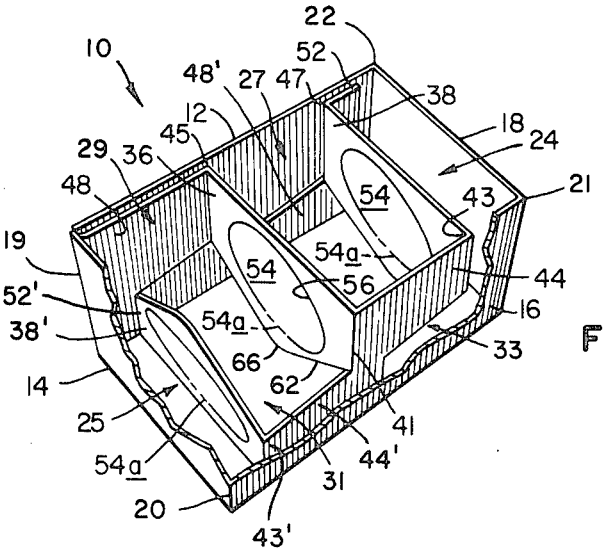
FIG. 1 is a perspective view with parts cut away of a two bulb carton embodying the principles of this invention.
Figure 2:
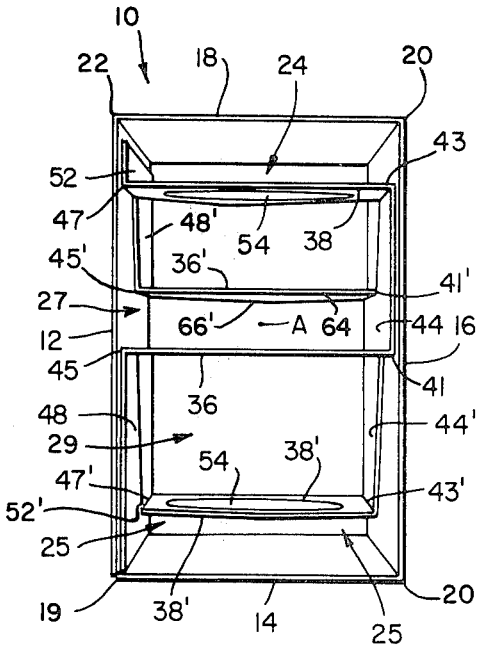
FIG. 2 is an end elevational view of the FIG. 1 carton.
Figure 3:
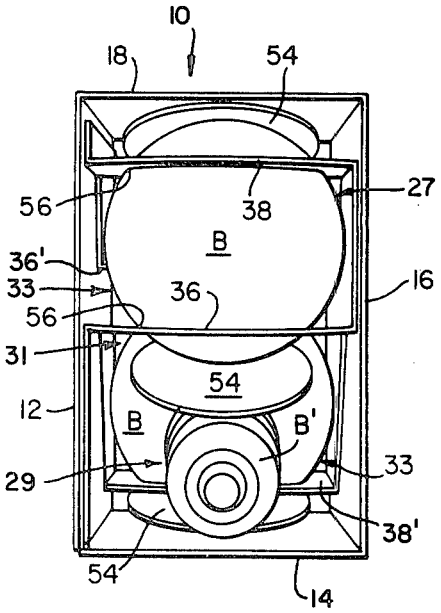
FIG. 3 is a view similar to FIG. 2 showing how the bulbs are received in the carton.

Referring to FIGS. 1 to 3 of the drawings, the subject carton, indicated generally at 10, comprises four rectangular wall panels, 12, 14, 16 and 18, hinged together at hinge lines 19, 20, 21 and 22 respectively to form an open-ended tube.

A first U-shaped partition structure shown generally at 24 is positioned inside the carton adjacent one end thereof. A second U-shaped partition structure shown generally at 25 is positioned inside the carton adjacent the opposite end thereof. The lengths of the two structures in the direction of the longitudinal axis of the carton combine to more or less equal the overall length of the carton. Furthermore, the two structures 24 and 25 are staggered transversely relative to one another so that they overlap adjacent the longitudinal axis A of the carton as best seen in FIG. 2. The overlap is such that the partition structure 24 defines a first compartment 27 and a second compartment 29 adjacent one end of the carton while the partition structure 25 defines a first compartment 31 and a second compartment 33 at the opposite end of the carton. Thus the U-shaped structures 24 and 25 have reverse symmetry and the compartments defined by those structures have the opposite sense.

As shown in FIG. 3, a bulb B can be inserted into the compartment at one end of the carton, say compartment 27, with the narrow bulb end B′ projecting into the compartment 33 aligned with compartment 27 at the opposite end of the carton. A similar bulb B can be inserted endwise into the compartment 31 at the opposite end of the carton so that its smaller end B′ projects into the compartment 29 at said one end of the carton. Thus the panel structures 24 and 25 support a pair of bulbs B within carton 10 and protectively isolate those bulbs from each other and from the outside wall panels of the carton. Resultantly, in the event the carton is dropped or struck from without, that force is not transmitted directly to the bulbs inside the carton.

As will be seen later, carton 10 is made from a single cardboard blank using a minimum amount of board stock and a minimum number of folding and glueing operations. Furthermore the carton may be flattened when not in use so that it can be shipped and stored in a minimum amount of space, thus minimizing handling costs.

Referring to FIGS. 1 and 2, the legs of the U-shaped structure 24 comprise a pair of parallel partition panels 36 and 38 spaced inwardly at unequal distances from carton wall panels 14 and 18 respectively. These panels 36 and 38 extend approximately half-way along the length of the carton. The corresponding ends of the panels 36 and 38 are hinged at 41 and 43 respectively to a bridging panel 44 which is secured to carton wall panel 16. The opposite ends of panels 36 and 38 are hinged a 45 and 47 respectively to a panel 48 and a glue flap 52 secured to the carton wall panel 12.

As viewed from the opposite end of the carton, the panel structure 25 is more or less the same as structure 24 in that it comprises a pair of parallel partition panels 36′ and 38′ spaced unequal distances inwardly from the carton wall panels 18 and 14 respectively. Corresponding ends of panels 36′ and 38′ are hinged at 41′ and 43′ respectively to a bridging panel 44′ which is secured to the carton wall panel 16. The opposite ends of panels 36′ and 38′ are hinged at 45′ and 47′ respectively to panels 48′ and 52′ secured to the carton wall panel 12.

As best seen in FIGS. 1 and 2, the two panel structures 24 and 25 are staggered so that their inboard leg panels 36 and 36′ are spaced close together on opposite sides of the longitudinal axis A of the carton. Furthermore, they are shaped and dimensioned to have relatively wide areas with zig-zag edges 62 and 64 adjacent the longitudinal axis of the carton forming noses 66 and 66′ which overlap one another at that location.

A tongue or flap 54 is formed in each panel, with the major axis of each tongue being oriented more or less perpendicular to the longitudinal axis of the carton and with each tongue connection 54*a* to its panel being located adjacent the transverse center line of the carton. Thus each tongue defines an opening 56 in a partition panel. These openings are sized to receive and retain the bulbous portion of a bulb B.

As best seen in FIG. 3, the dimensions of the carton panels are such that when bulbs B are inserted into the compartments 29 and 33 and retained in openings 56, the walls of the bulbs are spaced somewhat from the carton outer walls 14 and 18. Moreover the tongues 54 deflected outwardly from those openings by the bulb provide additional separators between the bulbs and those carton walls, as well as between each bulb and the adjacent end B′ of the other bulb. The heights of the partition panels is such that the bulbs are also spaced to some degree from the carton outer walls 12 and 16.

Furthermore, the overlapping partition noses 66 and 66′ form a relatively large area double wall between the two bulbs B thereby helping to effectively isolate the two bulbs from one another. Consequently, no part of either bulb is in direct contact with the other bulb or with an outside wall panel. Consequently the bulbs are well protected and buffered from shocks due to impact forces on the carton.

The bulbs B are inserted into compartments 27 and 31 of carton 10 from the opposite ends of the carton. The bulbs displace the partition panels 36, 38, and 36′, 38′ until the bulbous portions snap into the corresponding openings 56 in the partition panels. These openings are preferably elliptical because when the partition panels are bowed out to some extent by the bulbs, the openings assume a circular shape whose edges tend to firmly grip the bulbs as shown in FIG. 3. Accordingly, even though the carton is dropped on end, the bulbs which are recessed into the carton ends do not become dislodged from their openings.

Of course, if desired, the carton may be provided with additional conventional cover panels at one or both ends to completely enclose the bulbs.

Figure 4:
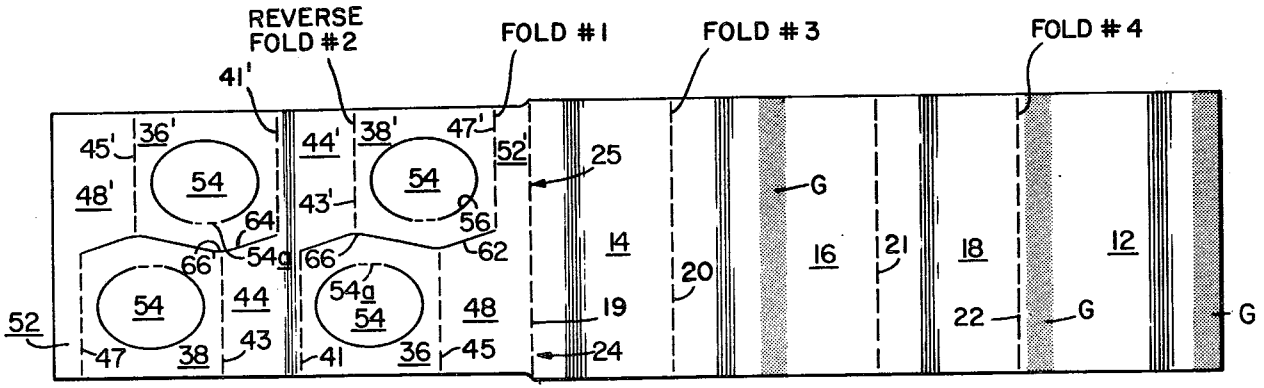
FIG. 4 is a plan view showing the blank from which the FIG. 1 carton is made.
Figure 5:
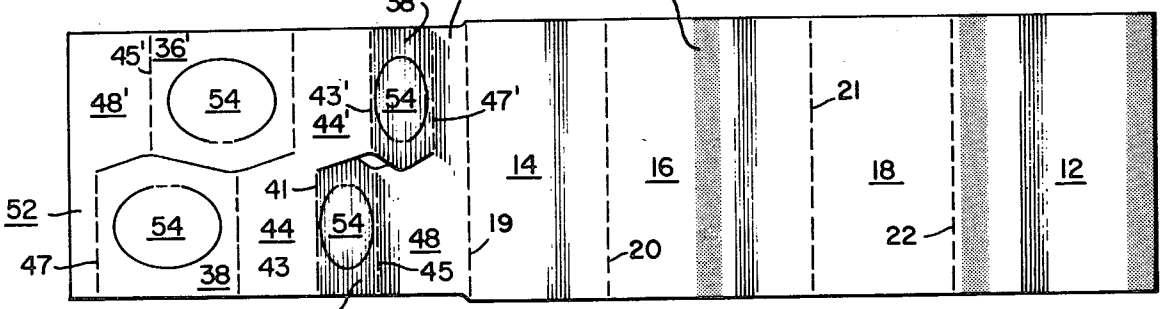
FIG. 5 is a view similar to FIG. 4 showing the blank partially folded to form the carton.
Figure 6:
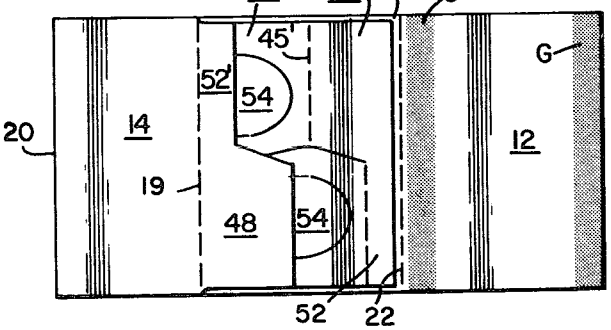
FIG. 6 is a similar view showing the blank after its second and next-to-last fold to form the finished carton.

FIGS. 4 to 6 illustrate the cardboard blank from which the FIG. 1 carton is made and the various folding and glueing operations involved in forming the carton. The panel flaps and hinge lines carry the same identifying numerals assigned to the corresponding elements in FIGS. 1 to 3. Preferably the undersurface of the FIG. 4 blank is provided with a finished calendared paper surface which may be white or colored so that, when the blank is folded as shown, the carton 10 has a finished exterior finish.

In forming the finished carton from the FIG. 4 blank, zig-zag slits are cut in the blank to form edges 62 and 64 as indicated. Simultaneously the elliptical tongues 54 are struck into the blank forming the openings 56 in partition panels 36, 36′, 38 and 38′. In addition, the hinge lines 41, 41′, 43, 43′, 45, 45′, 47 and 47′ are nicked so that the blank folds easily along those lines. Also a glue line G is printed along wall panel 16 midway across its width. Similar glue lines G are printed at the opposite side edge margins of panel 12.

Next, as best seen in FIG. 5, the portion of the blank to the left of hinge line 47′ is step folded along that hinge line and line 45 with the blank being reverse folded at hinge lines 41 and 43′ so the partition panel 38′ is folded down onto wall panel 14 with partition panel 36 being folded down onto bridging panel 48. Next, the blank is folded along hinge line 20, with the bridging panel 44′ being adhered to glue line G on panel 16. Finally, panel 12 is folded along hinge line 22 so that its left hand glue line G adheres to panel 48′ and flap 52 and its right hand glue lines G adhere to the outside surfaces of bridging panel 48 and glue flap 52′. That is the knocked down condition of the carton in which the carton is shipped so that a large number of such cartons occupy a minimum amount of space. The carton is erected simply by squaring it up. Thereupon bulbs B are inserted into the carton from opposite ends as described above.

It will be seen from the foregoing then that, using a relatively small amount of stock and only three folding operations, there results a protective carton for a pair of light bulbs or other fragile articles which provides a considerable amount of protection to those bulbs from impacts due to rough handling.

It will also be seen that the objects set forth above, among those made apparent from the preceding description, are effectively attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described.

We claim:

1. In a two bulb carton of the type having four walls hinged together to form a tube, the improvement comprising A. a first generally U-shaped partition structure situated at one end of the tube, said partition structure including a pair of partition panels spaced from and parallel to a first pair of said walls, so as to define a first pair of compartments at said one end of the tube, B. a second partition structure positioned adjacent the opposite end of the tube, said second partition structure including a pair of partition panels spaced from and parallel to said pair of walls so as to define a second pair of compartments at the other end of the tube, said partition structures being positioned in the tube with reverse symmetry so that the compartments at one end of the tube are in line with their opposite numbers at the other end of the tube, and C. means defining relatively large openings in said partition panels so that a pair of bulbs or other bulbous articles inserted into the corresponding compartments at opposite ends of the tube and projecting into the aligned compartments at the opposite ends of the tube will be received and retained in said openings.

2. The carton defined in claim 1 wherein the two panel structures are offset laterally with respect to the longitudinal axis of the tube so that inboard partition panels of each structure are spaced closely apart on opposite sides of said longitudinal axis and overlap one another to provide a divider of double thickness between a pair of bulbs or other objects retained in the carton.

3. In a two bulb carton of the type having four walls hinged together to form an open ended tube, the improvement comprising A. first panel structure positioned adjacent one end of the tube for dividing that tube end so that it has a first compartment and an adjacent second compartment, B. second panel structure positioned adjacent the opposite end of the tube, said second panel structure dividing the opposite end of the tube so that it has a third compartment and an adjacent fourth compartment, said panel structures being positioned relative to the longitudinal axis of the tube so that they overlap one another whereby the first compartment at one end of the tube is aligned with the fourth compartment at the opposite end of the tube and the second compartment at said one end of the tube is aligned with the third compartment at the opposite end of the tube.

4. The carton defined in claim 3 wherein each partition structure is generally U-shaped and includes a pair of spaced-apart leg-forming panels spaced parallel to one pair of said wall panels and a bridging panel hinged to corresponding edges of said leg-forming panels and adhered to one of the other pair of wall panels and additional panel means hinged to the opposite edges of said leg-forming panels, said additional panels being adhered to the other of said other pair of wall panels.

5. The carton defined in claim 3 and further including means defining openings in said partition panels, said openings being arranged and adapted to receive and retain the bulbous portion of a bulb.

6. The carton defined in claim 5 wherein said opening defining means comprise generally elliptical tongues struck from said partition panels.

7. A blank for forming a two bulb carton comprising a pair of partition panels hinged together, each partition panel having a slit extending more or less perpendicular to its hinge line to the other panel part way along its length, each partition panel also having a set of staggered hinge lines permitting said partition panel to be step folded so that the portions of that panel on opposite sides of the slit are spaced parallel to one another with the panel portions in the two partition panels having reverse symmetry and at least four additional generally rectangular panels hinged to said partition panels along lines parallel to the hinges between said partition panels.

* * * * *